US011315473B2

(12) United States Patent
Quan et al.

(10) Patent No.: US 11,315,473 B2
(45) Date of Patent: Apr. 26, 2022

(54) GATE-ON-ARRAY DRIVING CIRCUIT

(71) Applicant: TCL CHINA STAR OPTOELECTRONICS TECHNOLOGY CO., LTD., Guangdong (CN)

(72) Inventors: Haiyan Quan, Guangdong (CN); Xiaowen Lv, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 112 days.

(21) Appl. No.: 16/979,876

(22) PCT Filed: Jun. 16, 2020

(86) PCT No.: PCT/CN2020/096331
§ 371 (c)(1),
(2) Date: Sep. 11, 2020

(87) PCT Pub. No.: WO2021/217814
PCT Pub. Date: Nov. 4, 2021

(65) Prior Publication Data

US 2021/0335206 A1 Oct. 28, 2021

(51) Int. Cl.
*G09G 5/00* (2006.01)
*G09G 3/20* (2006.01)
(Continued)

(52) U.S. Cl.
CPC ..... *G09G 3/2092* (2013.01); *G09G 3/20* (2013.01); *G09G 3/3266* (2013.01);
(Continued)

(58) Field of Classification Search
CPC ..... G09G 3/20; G09G 3/2092; G09G 3/3266; G09G 3/3677; G09G 2300/0408; G09G 2310/0267; G09G 2310/0286
See application file for complete search history.

(56) References Cited

U.S. PATENT DOCUMENTS

2014/0111413 A1* 4/2014 Chen ..... G09G 3/3677 377/64
2016/0111065 A1* 4/2016 Wang ..... G09G 3/3677 345/99
(Continued)

FOREIGN PATENT DOCUMENTS

CN 105575357 A 5/2016
CN 106023936 A 10/2016
(Continued)

*Primary Examiner* — Adam J Snyder
(74) *Attorney, Agent, or Firm* — The Roy Gross Law Firm, LLC; Roy Gross

(57) ABSTRACT

A gate-on-array (GOA) driving circuit is provided, and the GOA driving circuit includes a plurality of cascading GOA driving units. Each of the GOA driving units further includes a first GOA driving sub-unit including a first signal source and a second GOA driving sub-unit including a second signal source. The first GOA driving sub-unit operates when the first signal source transmits a first signal with a high voltage, and the second GOA driving sub-unit transmitting a second signal operates when the first signal source transmits the first signal with a low voltage.

19 Claims, 3 Drawing Sheets

(51) Int. Cl.
*G09G 3/3266* (2016.01)
*G09G 3/36* (2006.01)

(52) U.S. Cl.
CPC ... *G09G 3/3677* (2013.01); *G09G 2300/0408* (2013.01); *G09G 2310/0267* (2013.01); *G09G 2310/0286* (2013.01)

(56) References Cited

U.S. PATENT DOCUMENTS

| | | | | |
|---|---|---|---|---|
| 2016/0307641 | A1* | 10/2016 | Zheng | G09G 3/3677 |
| 2017/0178581 | A1* | 6/2017 | Li | G09G 3/3677 |
| 2017/0178582 | A1* | 6/2017 | Li | G09G 3/3677 |
| 2017/0236479 | A1* | 8/2017 | Li | G09G 3/3677 345/213 |
| 2018/0342187 | A1* | 11/2018 | Shan | G09G 3/20 |
| 2019/0115090 | A1* | 4/2019 | Tao | G09G 3/20 |
| 2019/0139486 | A1* | 5/2019 | Li | G09G 3/3677 |
| 2019/0251891 | A1 | 8/2019 | Tang et al. | |
| 2019/0311691 | A1* | 10/2019 | Feng | G09G 3/3677 |
| 2020/0020410 | A1* | 1/2020 | Du | G09G 3/3677 |
| 2020/0043564 | A1* | 2/2020 | Li | G09G 3/20 |
| 2021/0134249 | A1 | 5/2021 | Wu et al. | |

FOREIGN PATENT DOCUMENTS

| | | | |
|---|---|---|---|
| CN | 106847195 | A | 6/2017 |
| CN | 108320692 | A | 7/2018 |
| CN | 109961745 | A | 7/2019 |
| CN | 110085183 | A | 8/2019 |
| KR | 20050068176 | A | 7/2005 |
| KR | 20070002556 | A | 1/2007 |

* cited by examiner

GATE-ON-ARRAY DRIVING CIRCUIT

TECHNICAL FIELD

The present invention relates to a display technology field, in particular to a gate-on array (GOA) driving circuit.

BACKGROUND

With development of gate-on-array (GOA) technology, gate driving circuits connected to scan lines may be manufactured around a display area on a substrate by original processes for manufacturing a display panel, instead of using external integrated circuits connected to scan lines to drive gate electrodes. According to the GOA technology, not only does it reduce binding to the external integrated circuits and production cost, but it also becomes a technical key to manufacture narrow-border or borderless display products.

In order to meet market requirements, a plurality of GOA driving sub-units usually need to be verified. However, if the GOA driving sub-units need to be verified, this often requires a completely new layout or new photomasks, thereby increasing verification cost of the GOA driving sub-units, which indirectly reduces opportunities to verify the GOA driving sub-units.

Therefore, it is necessary to propose a GOA driving circuit that increases verification opportunities for the plurality of GOA driving sub-units and to reduce verification cost.

Technical Problem

An object of the present invention is to provide a gate-on-array (GOA) driving circuit that increases verification opportunities for a plurality of GOA driving sub-units and to reduce verification cost.

Technical Solution

In order to achieve the above object, an aspect of the present invention provides a gate-on-array (GOA) driving circuit, comprising a plurality of cascading GOA driving units, wherein an $N^{th}$-staged GOA driving unit transmits a signal to an $N^{th}$-staged scan line corresponding to the $N^{th}$-staged GOA driving unit, and each of the GOA driving units comprises:

a first GOA driving sub-unit, comprising a first signal source, a first bridging thin film transistor, a second bridging thin film transistor, and a third bridging thin film transistor, wherein the first signal source is configured to transmit a first signal to a corresponding scan line; and a second GOA driving sub-unit, comprising a second signal source, wherein the second GOA driving sub-unit is connected to the first bridging thin film transistor, the second bridging thin film transistor, and the third bridging thin film transistor, and the second signal source is configured to transmit a second signal to the corresponding scan line;

wherein the first GOA driving sub-unit operates when the first signal source transmits the first signal with a high voltage, and the second GOA driving sub-unit transmitting the second signal operates when the first signal source transmits the first signal with a low voltage.

Further, the first signal source is an operating voltage.

Further, the second signal source is a clock signal.

Further, the first GOA driving sub-unit comprises:

a source terminal and a gate terminal of a first thin film transistor connected to a constant high voltage, and a drain terminal of the first thin film transistor connected to a first signal node and a gate terminal of the first bridging thin film transistor;

a source terminal of a second thin film transistor connected to a constant low voltage, a gate terminal of the second thin film transistor connected to the first signal source, a gate terminal of the second bridging thin film transistor, and a source terminal of the third bridging thin film transistor, and a drain terminal of the second thin film transistor connected to the first signal node, the drain terminal of the first thin film transistor, and the gate terminal of the first bridging thin film transistor;

a source terminal and a drain terminal of the first bridging thin film transistor connected to the second GOA driving sub-unit, and the gate terminal of the first bridging thin film transistor connected to the first signal node, the drain terminal of the first thin film transistor, and the drain terminal of the second thin film transistor;

a source terminal of the second bridging thin film transistor connected to the second GOA driving sub-unit, the gate terminal of the second bridging thin film transistor connected to the first signal source, the gate terminal of the second thin film transistor, and the source terminal of the third bridging thin film transistor, and a drain terminal of the second bridging thin film transistor connected to a gate terminal of the third bridging thin film transistor; and the source terminal of the third bridging thin film transistor connected to the first signal source, the gate terminal of the second thin film transistor, and the gate terminal of the second bridging thin film transistor, the gate terminal of the third bridging thin film transistor connected to the drain terminal of the second bridging thin film transistor, and a drain terminal of the third bridging thin film transistor connected to the second GOA driving sub-unit and the corresponding scan line.

Further, when the first signal source transmits the first signal with the high voltage, the first bridging thin film transistor is in a turned-off state, and the second bridging thin film transistor is in a turned-on state.

Further, the first thin film transistor and the second thin film transistor are deployed as an inverter.

Further, when the second signal source transmits the second signal with the low voltage, the corresponding scan line receives a part of the first signal.

Further, the first signal received by the corresponding scan line in a case that the second signal source transmits the second signal with the high voltage is stronger than the first signal received by the corresponding scan line in a case that the second signal source transmits the second signal with the low voltage.

Further, when the first signal source transmits the first signal with the low voltage, the first bridging thin film transistor is in a turned-on state, and the second bridging thin film transistor is in a turned-off state.

Further, when the second signal source transmits the second signal with the low voltage, the corresponding scan line and the second signal source are in the turned-on state.

Further, when the second signal source transmits the second signal with the low voltage, the corresponding scan line receives no signal.

Further, when the second signal source transmits the second signal with the high voltage, the corresponding scan line receives the second signal with the high voltage.

Further, the second GOA driving sub-unit comprises:

a source terminal and a gate terminal of a third thin film transistor are connected to an $M^{th}$-staged starting voltage, and a drain terminal of the third thin film transistor is connected to a second signal node and the source terminal of the second bridging thin film transistor;

a source terminal of a fourth thin film transistor connected to the second signal source and the source terminal of the first bridging thin film transistor, a gate terminal of the fourth thin film transistor connected to the second signal node, the drain terminal of the third thin film transistor, and the source terminal of the second bridging thin film transistor, and a drain terminal of the fourth thin film transistor connected to an $N^{th}$-staged starting voltage;

a first terminal of a bootstrap capacitor connected to the second signal node, the drain terminal of the third thin film transistor, the gate terminal of the fourth thin film transistor, and the source terminal of the second bridging thin film transistor, and a second terminal of the bootstrap capacitor connected to the drain terminal of the fourth thin film transistor and the $N^{th}$-staged starting voltage;

a source terminal of a fifth thin film transistor is connected to a constant low voltage, a gate terminal of the fifth thin film transistor connected to a $P^{th}$-staged starting voltage, and a drain terminal of the fifth thin film transistor connected to the drain terminal of the third thin film transistor, the second signal node, the first terminal of the bootstrap capacitor, the gate terminal of the fourth thin film transistor, and the source terminal of the second bridging thin film transistor;

a source terminal of a sixth thin film transistor connected to the constant low voltage and the source terminal of the fifth thin film transistor, a gate terminal of the sixth thin film transistor connected to the gate terminal of the fifth thin film transistor and the $P^{th}$-staged starting voltage, and a drain terminal of the sixth thin film transistor connected to the drain terminal of the fourth thin film transistor, the second terminal of the bootstrap capacitor, and the $N^{th}$-staged starting voltage;

a source terminal of a seventh thin film transistor connected to the constant low voltage, the source terminal of the fifth thin film transistor, and the source terminal of the sixth thin film transistor, a gate terminal of the seventh thin film transistor connected to the gate terminal of the fifth thin film transistor, the $P^{th}$-staged starting voltage, and the gate terminal of the sixth thin film transistor, and a drain terminal of the seventh thin film transistor connected to the drain terminal of the third bridging thin film transistor and the corresponding scan line; and a source terminal of an eighth thin film transistor connected to the drain terminal of the first bridging thin film transistor, a gate terminal of the eighth thin film transistor connected to the gate terminal of the fourth thin film transistor, the first terminal of the bootstrap capacitor, the second signal node, the drain terminal of the third thin film transistor, the drain terminal of the fifth thin film transistor, and the source terminal of the second bridging thin film transistor, and a drain terminal of the eighth thin film transistor is connected to the drain terminal of the third bridging thin film transistor, the corresponding scan line, and the drain terminal of the seventh thin film transistor;

wherein, M and P are natural numbers less than and greater than N, respectively.

Further, the $M^{th}$-staged starting voltage is a $(N-4)^{th}$-staged starting voltage.

Further, the $P^{th}$-staged starting voltage is a $(N+4)^{th}$-staged starting voltage.

Further, a voltage of the second signal transmitted by an $N^{th}$-staged second signal source is synchronized with the $N^{th}$-staged starting voltage.

Further, when the second signal source transmits the second signal with the low voltage, the $N^{th}$-staged starting voltage is at the low voltage, and the $M^{th}$-staged starting voltage and the $P^{th}$-staged starting voltage are at high voltages.

Further, when the second signal source transmits the second signal with the high voltage, the $N^{th}$-staged starting voltage is at the high voltage, and the $M^{th}$-staged starting voltage and the $P^{th}$-staged starting voltage are at low voltages.

Further, a voltage of the second signal node in a case that the second signal source transmits the second signal with the high voltage is stronger than the voltage of the second signal in a case that the second signal source transmits the second signal with the low voltage.

Beneficial Effect

In the present invention, switches between two different gate-on array (GOA) driving sub-units are controlled by a voltage of a first signal transmitted by a first signal source. That is, when the first signal source transmits the first signal with a high voltage, a first GOA driving sub-unit operates (transmitting the first signal to a corresponding scan line), and when the first signal source transmits the first signal with a low voltage, the second GOA driving sub-unit operates (transmitting a second signal to the corresponding scan line). Compared with the prior art, according to the present invention, verification opportunities for the plurality of GOA driving sub-units are increased, thus reducing verification cost.

DETAILED DESCRIPTION OF PREFERRED EMBODIMENTS

In order to make objectives, technical solutions and effects of the present invention more clear and specific, the present invention is described in further detail below with reference to appending drawings. It should be understood that specific embodiments described herein are only used to explain the present invention and are not intended to limit the present invention.

The following descriptions for respective embodiments refer to the appending drawings to illustrate embodiments of the present invention that can be implemented. Spatially relative terms mentioned in the present invention refer only to directions referring to the appending drawings. Therefore, the used spatially relative terms is configured to illustrate and understand the present invention, not to limit the present invention.

Figure 1:
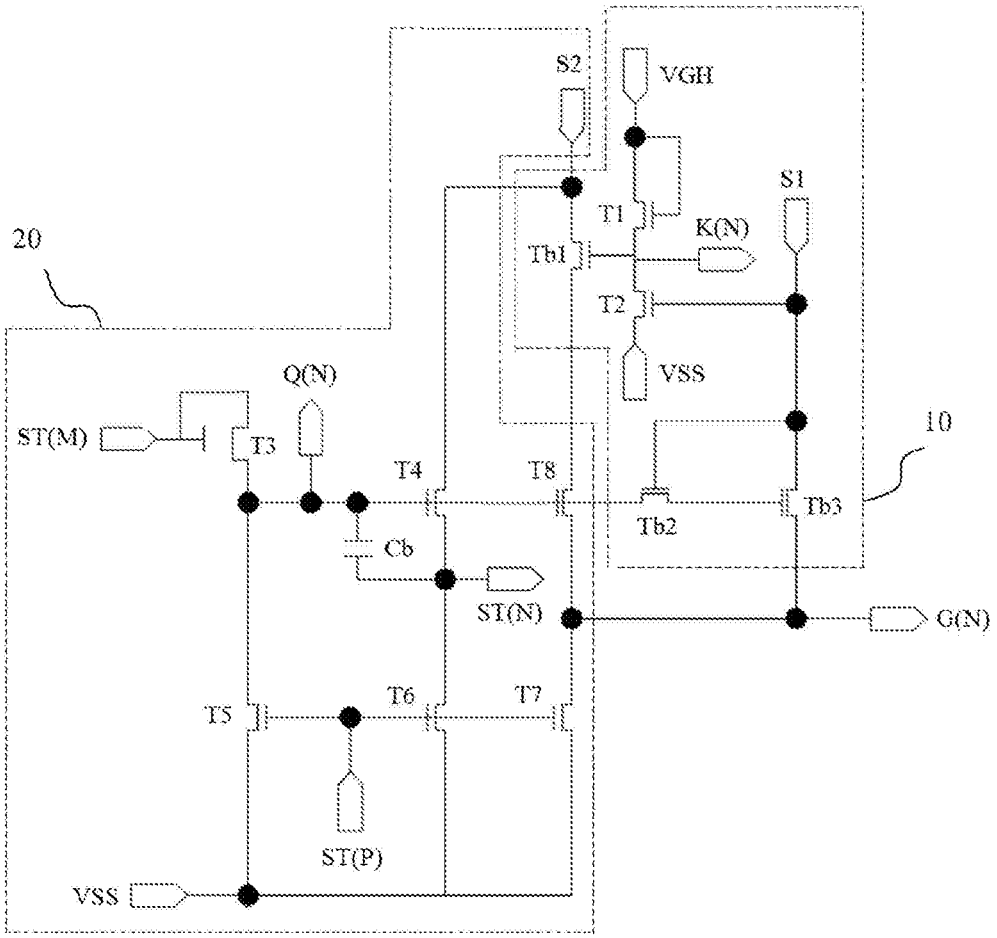
FIG. 1 is a schematic diagram showing a gate-on-array (GOA) driving unit according to an embodiment of the present invention.

Referring to FIG. 1, it is a schematic diagram showing a gate-on-array (GOA) driving unit according to an embodiment of the present invention. The GOA driving circuit includes a plurality of cascading GOA driving units, and an $N^{th}$-staged GOA driving unit transmits a signal to an $N^{th}$-staged scan line G(N) corresponding to the $N^{th}$-staged GOA driving unit (including a first signal and a second signal described below). For the sake of convenience for describing, in the embodiment of the present invention, the $N^{th}$- staged GOA driving unit is used to explain. Therefore, "a corresponding scan line G(N)" described below refers to "an $N^{th}$-staged scan line G(N)", "a first signal source S1" refers to "an $N^{th}$-staged first signal source S1(N)", and "a second signal source S2" refers to "an $N^{th}$-staged second signal source S2(N)". Unless otherwise specifically specified, it will not be repeated.

Further, each of the GOA driving units further includes a first GOA driving sub-unit 10 and a second GOA driving sub-unit 20, wherein the first GOA driving sub-unit 10 includes a first signal source S1, a first bridging thin film transistor Tb1, a second bridging thin film transistor Tb2, and a third bridging thin film transistor Tb3. The first signal source S1 (such as an operating voltage VDD) is configured to transmit a first signal to a corresponding scan line G(N). The second GOA driving sub-unit 20 includes a second signal source S2 (such as a clock signal CK), and the second GOA driving sub-unit 20 is connected to the first bridging thin film transistor Tb1, the second bridging thin film transistor Tb2, and the third bridging thin film transistor Tb3 (details will be described later), and the second signal source S2 is configured to transmit a second signal to the corresponding line G(N).

Specifically, the first GOA driving sub-unit 10 includes a first thin film transistor T1, a second thin film transistor T2, the first bridging thin film transistor Tb1, the second bridging thin film transistor Tb2, and the third bridging thin film transistor Tb3.

Further, a source terminal and a gate terminal of the first thin film transistor T1 are connected to a constant high voltage VGH, a drain terminal of the first thin film transistor T1 is connected to a first signal node K(N), a drain terminal of the second thin film transistor T2, and a gate terminal of the first bridging thin film transistor Tb1. A source terminal of the second thin film transistor T2 is connected to a constant low voltage VSS, a gate terminal of the second thin film transistor T2 is connected to the first signal source S1, a gate terminal of the second bridging thin film transistor Tb2, and a source terminal of the third bridging thin film transistor Tb3. The drain terminal of the second thin film transistor T2 is connected to the first signal node K(N), the drain terminal of the first thin film transistor T1, and the gate terminal of the first bridging thin film transistor Tb1. A source terminal and a drain terminal of the first bridging thin film transistor Tb1 are connected to the second GOA driving sub-unit 20 (specifically, the source terminal of the first bridging thin film transistor Tb1 is connected to the second signal source S2 and a source terminal of a fourth thin film transistor T4, the drain terminal of the first bridging thin film transistor Tb1 is connected to a source terminal of a eighth thin film transistor T8), the gate terminal of the first bridging thin film transistor Tb1 is connected to the first signal node K(N), the drain terminal of the first thin film transistor T1, and the drain terminal of the second thin film transistor T2. A source terminal of the second bridging thin film transistor Tb2 is connected to the second GOA driving sub-unit 20 (specifically connected to a drain terminal of a fifth thin film transistor T5, a drain terminal of a third thin film transistor T3, a second signal node Q(N), a first terminal of a bootstrap capacitor Cb, a gate terminal of the fourth thin film transistor T4, and a gate terminal of the eighth thin film transistor T8), the gate terminal of the second bridging thin film transistor Tb2 is connected to the first signal source S1, the gate terminal of the second thin film transistor T2, and the source terminal of the third bridging thin film transistor Tb3, and a drain terminal of the second bridging thin film transistor Tb2 is connected to a gate terminal of the third bridging thin film transistor Tb3. The source terminal of the third bridging thin film transistor Tb3 is connected to the first signal source S1, the gate terminal of the second thin film transistor T2, and the gate terminal of the second bridging thin film transistor Tb2. The gate terminal of the third bridging thin film transistor Tb3 is connected to the drain terminal of the second bridging thin film transistor Tb2, and a drain terminal of the third bridging thin film transistor Tb3 is connected to the first GOA driving sub-unit 20 (specifically connected to a drain terminal of a seventh thin film transistor T7 and a drain terminal of the eighth thin film transistor T8) and the corresponding scan line G(N).

Specifically, the second GOA driving sub-unit 20 further includes the third thin film transistor T3, the fourth thin film transistor T4, the bootstrap capacitor Cb, the fifth thin film transistor T5, a sixth thin film transistor T6, the seventh thin film transistor T7, and the eighth thin film transistor T8.

Further, a source terminal and a gate terminal of the third thin film transistor T3 are connected to an $M^{th}$ starting voltage ST(M), the drain terminal of the third thin film transistor T3 is connected to the second signal node Q(N), the first terminal of the bootstrap capacitor Cb, the gate terminal of the fourth thin film transistor T4, the gate terminal of the eighth thin film transistor T8, the source terminal of the second bridging thin film transistor Tb2, and the drain terminal of the fifth thin film transistor T5. The source terminal of the fourth thin film transistor T4 is connected to the second signal source S2 and the source terminal of the first bridging thin film transistor Tb1, the gate terminal of the fourth thin film transistor T4 is connected to the first terminal of the bootstrap capacitor Cb, the second signal node Q(N), the drain terminal of the third thin film transistor T3, the drain terminal of the fifth thin film transistor T5, the gate terminal of the eighth thin film transistor T8, and the source terminal of the second bridging thin film transistor Tb2, and a drain terminal of the fourth thin film transistor T4 is connected to an $N^{th}$-staged starting voltage ST(N), a drain terminal of the sixth thin film transistor T6, and a second terminal of the bootstrap capacitor Cb. The first terminal of the bootstrap capacitor Cb is connected to the second signal node Q(N), the drain terminal of the third thin film transistor T3, the drain terminal of the fifth thin film transistor T5, the gate terminal of the fourth thin film transistor T4, the gate terminal of the eighth thin film transistor T8, and the source terminal of the second bridging thin film transistor Tb2, the second terminal of the bootstrap capacitor Cb is connected to the drain terminal of the fourth thin film transistor T4, the $N^{th}$-staged starting voltage ST(N), and the drain terminal of the sixth thin film transistor T6. A source terminal of the fifth thin film transistor T5 is connected to the constant low voltage VSS, a source terminal of the sixth thin film transistor T6, and a source terminal of the seventh thin film transistor T7, a gate terminal of the fifth thin film transistor T5 is connected to a $P^{th}$-staged starting voltage ST(P), a gate terminal of the sixth thin film transistor T6, and a gate terminal of the seventh thin film transistor T7, and the drain terminal of the fifth thin film transistor T5 is connected to the drain terminal of the third thin film transistor T3, the second signal node Q(N), the first terminal of the bootstrap capacitor Cb, the gate terminal of the fourth thin film transistor T4, the gate terminal of the eighth thin film transistor T8, and the source terminal of the second bridging thin film transistor Tb2. The source terminal of the sixth thin film transistor T6 is connected to the constant low voltage VSS, the source terminal of the fifth thin film transistor T5, and the source terminal of the seventh thin film transistor T7, the gate terminal of the sixth thin film transistor T6 is connected to the gate terminal of the fifth thin film transistor T5, the $P^{th}$-staged starting voltage ST(P), and the gate terminal of the seventh thin film transistor T7, and the drain terminal of the sixth thin film transistor T6 is connected to the drain terminal of the fourth thin film transistor T4, the $N^{th}$-staged starting voltage ST(N), and the second terminal of the bootstrap capacitor Cb. The source terminal of the seventh thin film transistor T7 is connected to the constant low voltage VSS, the source terminal of the fifth thin film transistor T5, and the source terminal of the sixth thin film transistor T6, the gate terminal of the seventh thin film transistor T7 is connected to the gate terminal of the fifth thin film transistor T5, the $P^{th}$-staged starting voltage ST(P), and the gate terminal of the sixth thin film transistor T6, and the drain terminal of the seventh thin film transistor T7 is connected to the drain terminal of the eighth thin film transistor T8, the drain terminal of the third bridging thin film transistor Tb3, and the corresponding scan line G(N). The source terminal of the eighth thin film transistor T8 is connected to the drain terminal of the first bridging thin film transistor Tb1, the gate terminal of the eighth thin film transistor T8 is connected to the gate terminal of the fourth thin film transistor T4, the first terminal of the bootstrap capacitor Cb, the second signal node Q(N), the drain terminal of the third thin film transistor T3, the drain terminal of the fifth thin film transistor T5, and the source terminal of the second bridging thin film transistor Tb2, and the drain terminal of the eighth thin film transistor T8 is connected to the drain terminal of the seventh thin film transistor T7, the drain terminal of the third bridging thin film transistor Tb3, and the corresponding scan line G(N).

In the present embodiment, M and P are natural numbers less than and greater than N, respectively. Preferably, the $M^{th}$-staged starting voltage ST(M) is a $(N-4)^{th}$-staged starting voltage ST(N−4), and the $P^{th}$-staged starting voltage ST(P) is a $(N+4)^{th}$-staged starting voltage ST(N+4). A timing sequence control is realized by using different staged starting voltage. Persons skilled in this art may understand that the $M^{th}$-staged starting voltage ST(M) and the Pt-staged starting voltage ST(P) may be designed according to specific applications, and the present invention is not intended to be specifically limiting.

Figure 2A:
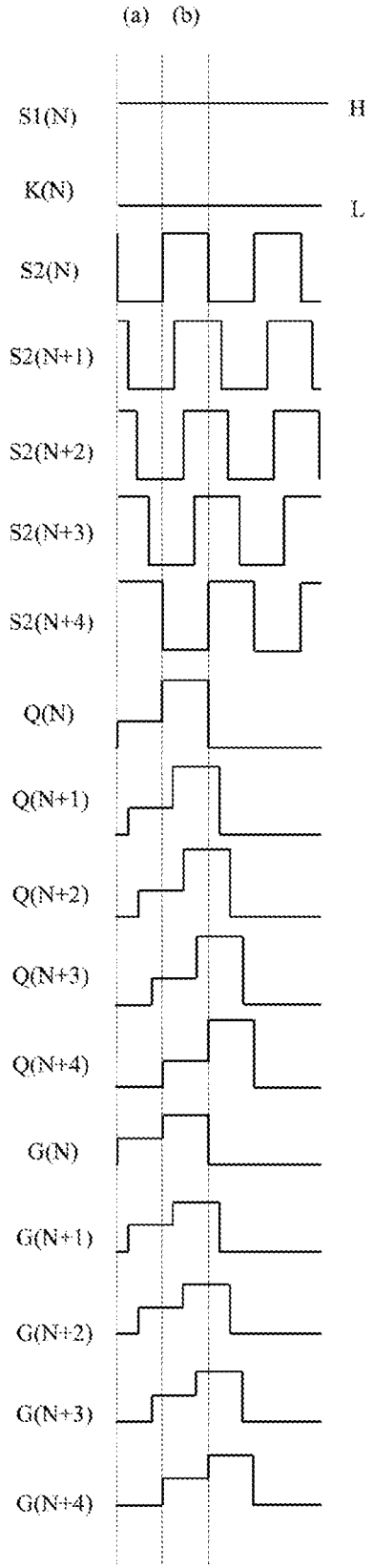
FIG. 2A is a timing sequence diagram showing a case that a first signal source transmits a high voltage according to the embodiment of the present invention.
Figure 2B:
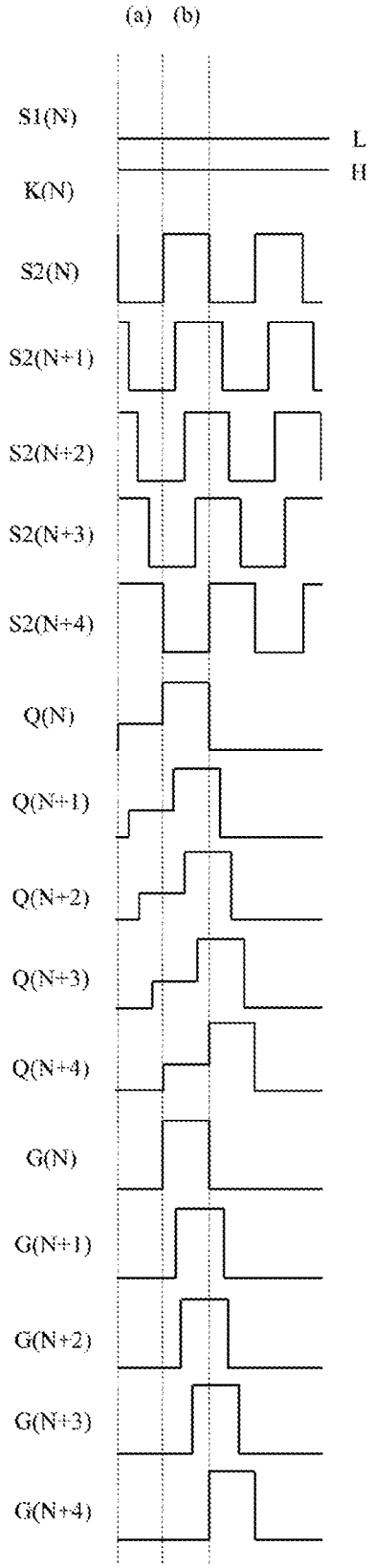
FIG. 2B is a timing sequence diagram showing a case that the first signal source transmits a low voltage according to the embodiment of the present invention.

In conjunction with FIG. 2A and FIG. 2B, FIG. 2A is a timing sequence diagram showing a case that the first signal source S1 transmits a high voltage according to the embodiment of the present invention, FIG. 2B is a timing sequence diagram showing a case that the first signal source S1 transmits a low voltage according to the embodiment of the present invention. Switches between two different GOA driving sub-units (that is, the first GOA driving sub-unit 10 and the second GOA driving sub-unit 20) are realized by the GOA driving circuit provided by the embodiment of the present invention.

Referring to FIG. 2A, when the first signal source S1 transmits the first signal with a high voltage, since the gate terminal of the first thin film transistor T1 and the gate terminal of the second thin film transistor T2 are connected to the constant high voltage VGH and the first signal source S1 transmitting the first signal with the high voltage, respectively, and the source terminals of the first thin film transistor T1 and the second thin film transistor T2 are connected to the constant high voltage VGH and the constant low voltage VSS, the first thin film transistor T1 and the second thin film transistor T2 are deployed as an inverter. That is, when the gate terminals of the first thin film transistor T1 and the second thin film transistor T2 are input a high voltage, a voltage of an output terminal connected to the drain terminals of the first thin film transistor T1 and the second thin film transistor T2 is at a low voltage (that is, the first signal node K(N) is at the low voltage), so that the first bridging thin film transistor Tb1 is in a turned-off state. Furthermore, since the gate terminal of the second bridging thin film transistor Tb2 receives the first signal with the high voltage, the second bridging thin film transistor Tb2 is in a turned-on state.

Further, since the $N^{th}$-staged second signal source S2 is connected to the $N^{th}$-staged starting voltage ST (N) through the fourth thin film transistor T4, a voltage of the second signal transmitted by the $N^{th}$-staged second signal source S2 is synchronized with the $N^{th}$-staged starting voltage ST(N), and same as other stages, it will not be repeated here. When the second signal source S2 transmits a second signal with the low voltage, the $N^{th}$-staged starting voltage ST(N) is at the low voltage, and the $(N+4)^{th}$-staged starting voltage ST(N+4) and the $(N-4)^{th}$-staged starting voltage ST(N−4) are at the high voltage (referring to (a) in FIG. 2A). Meanwhile, the third thin film transistor T3, the fourth thin film transistor T4, the fifth thin film transistor T5, the sixth thin film transistor T6, the seventh thin film transistor T7, the eighth thin film transistor T8, and the third bridging thin film transistor Tb3 are all in the turned-on state, so that the second signal node Q(N) is at the high voltage, the bootstrap capacitor Cb starts to charge, and the corresponding scan line G(N) may receive the first signal with the high voltage. It can be understood that since the seventh thin film transistor T7 and the eighth thin film transistor T8 are in the turned-on state, the first signal is shunted and cannot be fully received by the corresponding scan line G(N).

Further, when the second signal source S2 transmits a second signal with the high voltage, the $N^{th}$-staged starting voltage ST(N) is at the high voltage, and the $(N+4)^{th}$-staged starting voltage ST (N+4) and the $(N-4)^{th}$-staged starting voltage ST(N−4) are at the low voltages (referring to (b) in FIG. 2A). Meanwhile, the third thin film transistor T3, the fifth thin film transistor T5, the sixth thin film transistor T6, and the seventh thin film transistor T7 are in the turned-off state. Since the bootstrap capacitor Cb can continually provide a high voltage to the gate terminal of the fourth thin film transistor T4, the gate terminal of the eight thin film transistor T8, and the gate terminal of the third bridging thin film transistor Tb3, they are all in the turned-on state, and the corresponding scan line G(N) can receive the first signal with the high voltage. Moreover, since the seventh thin film transistor T7 and the eighth thin film transistor T8 are in the turned-off state, the first signals are fully received by the corresponding scan line G(N), so that the corresponding scan line G(N) has a stronger signal. In addition, when the second signal with the high voltage is transmitted to the source terminal of the fourth thin film transistor T4, a capacitive coupling effect may occur between the source terminal and the gate terminal of the fourth thin film transistor T4, making a voltage of the gate terminal of the fourth thin film transistor T4 further increase, so that a voltage of the second signal node Q(N) will increase accordingly.

Referring to FIG. 2B, when the first signal source S1 transmits the first signal with the low voltage, the gate terminal of the first thin film transistor T1 and the gate terminal of the second thin film transistor T2 are connected to the constant high voltage VGH and the first signal source S1 transmitting the first signal with the low voltage, so that the first thin film transistor T1 is in the turned-on state, and the second thin film transistor T2 is in the turned-off state. Moreover, the gate terminal of the first bridging thin film transistor Tb1 may receive the constant high voltage VGH (that is, the first signal node K(N) is at the high voltage), so that the first bridging thin film transistor Tb1 is also in the turned-on state. Furthermore, since the gate terminal of the second bridging thin film transistor Tb2 receives the first signal with the low voltage, the second bridging thin film transistor Tb2 is in the turned-off state, resulting in that the third bridging thin film transistor Tb3 is also in the turned-off state (that is, the gate terminal of the third bridging thin film transistor Tb3 fails to receive a signal with the high voltage).

Further, when the second signal source S2 transmits the second signal with the low voltage, the $N^{th}$-staged starting voltage ST(N) is at the low voltage, and the $(N+4)^{th}$-staged starting voltage ST(N+4) and the $(N-4)^{th}$-staged starting voltage ST(N−4) are at high voltages (referring to (a) in FIG. 2B). Meanwhile, the third thin film transistor T3, the fourth thin film transistor T4, the fifth thin film transistor T5, the sixth thin film transistor T6, the seventh thin film transistor T7, and the eighth thin film transistor T8 are all in the turned-on state, so that the second signal node Q(N) is at the high voltage, the bootstrap capacitor Cb starts to charge, and the corresponding scan line G(N) and the second signal source S2 are in the turned-on state (but there is no signals input to the corresponding scan line G(N)).

Further, when the second signal source S2 transmits the second signal with the high voltage, the $N^{th}$-staged starting voltage ST(N) is at the high voltage, and the $(N+4)^{th}$-staged starting voltage ST(N+4) and the $(N-4)^{th}$-staged starting voltage ST(N−4) are at the low voltage (referring to (b) in FIG. 2B). Meanwhile, the third thin film transistor T3, the fifth thin film transistor T5, the sixth thin film transistor T6, and the seventh thin film transistor T7 are all in the turned-off state, and the bootstrap capacitor Cb can continually provide the high voltage to the gate terminal of the fourth thin film transistor T4 and the gate terminal of the eight thin film transistor T8, so that they are all in the turned-on state, the corresponding scan line G(N) thus can receive the second signal with the high voltage through the first bridging thin film transistor Tb1 and the eighth thin film transistor T8. In addition, when the second signal with the high voltage is transmitted to the source terminal of the fourth thin film transistor T4, a capacitive coupling effect occurs between the source terminal and the gate terminal of the fourth thin film transistor T4, making a voltage of the gate terminal of the fourth thin film transistor T4 further increase, so that a voltage of the second signal node Q(N) increases accordingly.

In the present invention, switches between two different GOA driving sub-units are controlled by the voltage of the first signal transmitted by the first signal source S1. That is, when the first signal source transmits the first signal with the high voltage, the first GOA driving sub-unit operates, and when the first signal source S1 transmits the first signal with the low voltage, the second GOA driving sub-unit transmitting the second signal to the corresponding scan line operates. Compared with the prior art, according to the present invention, verification opportunities for the plurality of GOA driving sub-units are increased, thus reducing verification cost.

Although the present invention has been disclosed above in the preferred embodiments, the above preferred embodiments are not intended to limit the present invention. For persons skilled in this art, various modifications and alterations can be made without departing from the spirit and scope of the present invention. The protective scope of the present invention is subject to the scope as defined in the claims.

What is claimed is:

1. A gate-on-array (GOA) driving circuit, comprising a plurality of cascading GOA driving units, wherein an $N^{th}$-staged GOA driving unit transmits a signal to an $N^{th}$-staged scan line corresponding to the $N^{th}$-staged GOA driving unit, and each of the GOA driving units comprises:

a first GOA driving sub-unit, comprising a first signal source, a first bridging thin film transistor, a second bridging thin film transistor, and a third bridging thin film transistor, wherein the first signal source is configured to transmit a first signal to a corresponding scan line; and a second GOA driving sub-unit, comprising a second signal source, wherein the second GOA driving sub-unit is connected to the first bridging thin film transistor, the second bridging thin film transistor, and the third bridging thin film transistor, and the second signal source is configured to transmit a second signal to the corresponding scan line;

wherein the first GOA driving sub-unit operates when the first signal source transmits the first signal with a high voltage, and the second GOA driving sub-unit transmitting the second signal operates when the first signal source transmits the first signal with a low voltage.

2. The GOA driving circuit as claimed in claim 1, wherein the first signal source is an operating voltage.

3. The GOA driving circuit as claimed in claim 1, wherein the second signal source is a clock signal.

4. The GOA driving circuit as claimed in claim 1, wherein the first GOA driving sub-unit comprises:

a source terminal and a gate terminal of a first thin film transistor connected to a constant high voltage, and a drain terminal of the first thin film transistor connected to a first signal node and a gate terminal of the first bridging thin film transistor;

a source terminal of a second thin film transistor connected to a constant low voltage, a gate terminal of the second thin film transistor connected to the first signal source, a gate terminal of the second bridging thin film transistor, and a source terminal of the third bridging thin film transistor, and a drain terminal of the second thin film transistor connected to the first signal node, the drain terminal of the first thin film transistor, and the gate terminal of the first bridging thin film transistor;

a source terminal and a drain terminal of the first bridging thin film transistor connected to the second GOA driving sub-unit, and the gate terminal of the first bridging thin film transistor connected to the first signal node, the drain terminal of the first thin film transistor, and the drain terminal of the second thin film transistor;

a source terminal of the second bridging thin film transistor connected to the second GOA driving sub-unit, the gate terminal of the second bridging thin film transistor connected to the first signal source, the gate terminal of the second thin film transistor, and the source terminal of the third bridging thin film transistor, and a drain terminal of the second bridging thin film transistor connected to a gate terminal of the third bridging thin film transistor; and the source terminal of the third bridging thin film transistor connected to the first signal source, the gate terminal of the second thin film transistor, and the gate terminal of the second bridging thin film transistor, the gate terminal of the third bridging thin film transistor connected to the drain terminal of the second bridging thin film transistor, and a drain terminal of the third bridging thin film transistor connected to the second GOA driving sub-unit and the corresponding scan line.

5. The GOA driving circuit as claimed in claim 4, wherein the first thin film transistor and the second thin film transistor are deployed as an inverter.

6. The GOA driving circuit as claimed in claim 1, wherein when the first signal source transmits the first signal with the high voltage, the first bridging thin film transistor is in a turned-off state, and the second bridging thin film transistor is in a turned-on state.

7. The GOA driving circuit as claimed in claim 6, wherein when the second signal source transmits the second signal with the low voltage, the corresponding scan line receives a part of the first signal.

8. The GOA driving circuit as claimed in claim 6, wherein the first signal received by the corresponding scan line in a case that the second signal source transmits the second signal with the high voltage is stronger than the first signal received by the corresponding scan line in a case that the second signal source transmits the second signal with the low voltage.

9. The GOA driving circuit as claimed in claim 1, wherein when the first signal source transmits the first signal with the low voltage, the first bridging thin film transistor is in a turned-on state, and the second bridging thin film transistor is in a turned-off state.

10. The GOA driving circuit as claimed in claim 9, wherein when the second signal source transmits the second signal with the low voltage, the corresponding scan line and the second signal source are in the turned-on state.

11. The GOA driving circuit as claimed in claim 9, wherein when the second signal source transmits the second signal with the low voltage, the corresponding scan line receives no signal.

12. The GOA driving circuit as claimed in claim 9, wherein when the second signal source transmits the second signal with the high voltage, the corresponding scan line receives the second signal with the high voltage.

13. The GOA driving circuit as claimed in claim 1, wherein the second GOA driving sub-unit comprises:

a source terminal and a gate terminal of a third thin film transistor are connected to an $M^{th}$-staged starting voltage, and a drain terminal of the third thin film transistor is connected to a second signal node and the source terminal of the second bridging thin film transistor;

a source terminal of a fourth thin film transistor connected to the second signal source and the source terminal of the first bridging thin film transistor, a gate terminal of the fourth thin film transistor connected to the second signal node, the drain terminal of the third thin film transistor, and the source terminal of the second bridging thin film transistor, and a drain terminal of the fourth thin film transistor connected to an $N^{th}$-staged starting voltage;

a first terminal of a bootstrap capacitor connected to the second signal node, the drain terminal of the third thin film transistor, the gate terminal of the fourth thin film transistor, and the source terminal of the second bridging thin film transistor, and a second terminal of the bootstrap capacitor connected to the drain terminal of the fourth thin film transistor and the $N^{th}$-staged starting voltage;

a source terminal of a fifth thin film transistor is connected to a constant low voltage, a gate terminal of the fifth thin film transistor connected to a $P^{th}$-staged starting voltage, and a drain terminal of the fifth thin film transistor connected to the drain terminal of the third thin film transistor, the second signal node, the first terminal of the bootstrap capacitor, the gate terminal of the fourth thin film transistor, and the source terminal of the second bridging thin film transistor;

a source terminal of a sixth thin film transistor connected to the constant low voltage and the source terminal of the fifth thin film transistor, a gate terminal of the sixth thin film transistor connected to the gate terminal of the fifth thin film transistor and the $P^{th}$-staged starting voltage, and a drain terminal of the sixth thin film transistor connected to the drain terminal of the fourth thin film transistor, the second terminal of the bootstrap capacitor, and the $N^{th}$-staged starting voltage;

a source terminal of a seventh thin film transistor connected to the constant low voltage, the source terminal of the fifth thin film transistor, and the source terminal of the sixth thin film transistor, a gate terminal of the seventh thin film transistor connected to the gate terminal of the fifth thin film transistor, the $P^{th}$-staged starting voltage, and the gate terminal of the sixth thin film transistor, and a drain terminal of the seventh thin film transistor connected to the drain terminal of the third bridging thin film transistor and the corresponding scan line; and a source terminal of an eighth thin film transistor connected to the drain terminal of the first bridging thin film transistor, a gate terminal of the eighth thin film transistor connected to the gate terminal of the fourth thin film transistor, the first terminal of the bootstrap capacitor, the second signal node, the drain terminal of the third thin film transistor, the drain terminal of the fifth thin film transistor, and the source terminal of the second bridging thin film transistor, and a drain terminal of the eighth thin film transistor is connected to the drain terminal of the third bridging thin film transistor, the corresponding scan line, and the drain terminal of the seventh thin film transistor;

wherein, M and P are natural numbers less than and greater than N, respectively.

14. The GOA driving circuit as claimed in claim 13, wherein the $M^{th}$-staged starting voltage is a $(N-4)^{th}$-staged starting voltage.

15. The GOA driving circuit as claimed in claim 13, wherein the $P^{th}$-staged starting voltage is a $(N+4)^{th}$-staged starting voltage.

16. The GOA driving circuit as claimed in claim 13, wherein a voltage of the second signal transmitted by a $N^{th}$-staged second signal source is synchronized with the $N^{th}$-staged starting voltage.

17. The GOA driving circuit as claimed in claim 16, wherein when the second signal source transmits the second signal with the low voltage, the $N^{th}$-staged starting voltage is at the low voltage, and the $M^{th}$-staged starting voltage and the $P^{th}$-staged starting voltage are at high voltages.

18. The GOA driving circuit as claimed in claim 16, wherein when the second signal source transmits the second signal with the high voltage, the $N^{th}$-staged starting voltage is at the high voltage, and the $M^{th}$-staged starting voltage and the $P^{th}$-staged starting voltage are at low voltages.

19. The GOA driving circuit as claimed in claim 13, wherein a voltage of the second signal node in a case that the second signal source transmits the second signal with the high voltage is stronger than the voltage of the second signal in a case that the second signal source transmits the second signal with the low voltage.

* * * * *